US006860749B1

(12) United States Patent
Wu

(10) Patent No.: US 6,860,749 B1
(45) Date of Patent: Mar. 1, 2005

(54) CABLE END CONNECTOR ASSEMBLY HAVING LOCKING MEMBER

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/776,111

(22) Filed: Feb. 10, 2004

(51) Int. Cl.[7] ..... H01R 13/627
(52) U.S. Cl. ..... 439/352; 439/354; 439/607
(58) Field of Search ..... 439/352, 353, 439/354, 357, 358, 607, 610

(56) References Cited

U.S. PATENT DOCUMENTS 5,660,558 A * 8/1997 Osanai et al. ..... 439/353
5,879,194 A * 3/1999 Thenaisie et al. ..... 439/607
6,203,353 B1 * 3/2001 Huang et al. ..... 439/352
6,431,887 B1 * 8/2002 Yeomans et al. ..... 439/108
6,454,577 B1 * 9/2002 Yi ..... 439/108
6,485,315 B1 * 11/2002 Hwang ..... 439/108
6,565,383 B1 * 5/2003 Wu ..... 439/567
6,585,536 B1 * 7/2003 Wu ..... 439/358
6,585,537 B1 * 7/2003 Lee ..... 439/358
6,619,989 B1 * 9/2003 Yi ..... 439/610
6,648,665 B1 * 11/2003 Wu ..... 439/352
6,655,979 B1 * 12/2003 Lee ..... 439/357

* cited by examiner

*Primary Examiner*—Tho D. Ta
*Assistant Examiner*—Iarisa Tsukerman
(74) *Attorney, Agent, or Firm*—Wei Te Chung

(57) ABSTRACT

A cable end connector assembly (1) includes an insulative housing (12), a number of contacts (130) received in the insulative housing, a spacer (13) mounted to a rear end of the insulative housing, a cable (14) including a number of conductors (140, 142) electrically connecting with corresponding contacts, a cover (15) over-molded with the insulative housing and the cable, and a locking member (16). The housing forms a pair of wing portions (129) extending rearwardly therefrom. The cover defines a pair of passages (151) to receive the wing portions. The locking member includes a retaining portion (160) secured with the insulative housing, a pressing portion (162) engaged with the pair of wing portions, a pressing portion (163) engaged with the cover and a pair of latch sections (1610) located close to the retaining portion. The pressing portion moves downwardly and becomes curve toward the cover under a pressing force and creates a vertical displacement to the latch sections.

17 Claims, 11 Drawing Sheets

CABLE END CONNECTOR ASSEMBLY HAVING LOCKING MEMBER

CROSS-REFERENCE TO RELATED APPLICATIONS

This application is related to U.S. patent application Ser. No. 10/660,315 filed on Sep. 10, 2003 and entitled "CABLE END CONNECTOR ASSEMBLY WITH LOCKING MEMBER", Ser. No. 10/665,060 filed on Sep. 17, 2003 and entitled "CABLE END CONNECTOR ASSEMBLY HAVING LOCKING MEMBER", and Ser. No. 10/728,614 filed on Dec. 5, 2003 and entitled "CABLE END CONNECTOR ASSEMBLY HAVING LOCKING MEMBER", all of which are invented by the same inventor and assigned to the same assignee as this application.

BACKGROUND OF THE INVENTION

1. Field of the Invention

The present invention relates to a cable end connector assembly, and particularly to a cable end connector assembly having a locking member for locking with a complementary connector.

2. Description of Related Art

There exists in the art an electrical connector known as a Serial Advanced Technology Attachment (Serial ATA) connector which is generally used for disk drives and storage peripherals. Especially, the Serial ATA connectors according to the Serial ATA standard are featured in fewer electrical contacts than other conventional electrical connectors and are relatively tiny in configuration. It is desirable for the Serial ATA connector to have latch means for providing a reliable mechanical and electrical connection with a complementary connector. U.S. Pat. Nos. 6,565,383 and 6,585,536, having the same inventor and the same assignee with the present invention, each disclose a Serial ATA connector equipped with a locking member for locking with a complementary connector. The locking member comprises a middle portion retained on a connector housing, a pushing portion extending rearwardly from the middle portion, and a locking portion extending forwardly from the middle portion for locking/releasing the Serial ATA connector with/from the complementary connector.

However, the locking member is a cantilevered type structure, the vertical distance between a locking position and a releasing position of the locking portion is relatively small, thereby adversely affecting the engagement and disengagement between the Serial ATA connector and the complementary connector.

Hence, a cable end connector assembly having an improved locking member is desired.

SUMMARY OF THE INVENTION

An object of the present invention is to provide a cable end connector assembly having an improved locking member having relatively big displacement for locking/unlocking the cable end connector assembly with/from a complementary connector more conveniently.

To achieve the above object, a cable end connector assembly in accordance with the present invention comprises an insulative housing, a plurality of contacts received in the insulative housing, a spacer mounted to a rear end of the insulative housing, a cable comprising a plurality of conductors electrically connecting with corresponding contacts, a cover over-molded with the insulative housing and the cable, and a locking member. The housing forms a pair of wing portions extending rearwardly therefrom, and the cover defines a pair of passages to receive the wing portions. The locking member comprises at a front end thereof a retaining portion secured with the insulative housing, a supporting portion at a rear end thereof engaged with the cover, a pressing portion located on the rear end thereof close to the supporting portion and respectively engaged with the pair of wing portions of the insulative housing, and a locking portion extending rearwardly from the retaining portion. The locking portion comprises a pair of latch sections located close to the retaining portion for locking with the complementary connector. The pressing portion is movable downwardly and becomes curve toward the cover under a pressing force and creates a vertical displacement to the locking portion.

Other objects, advantages and novel features of the invention will become more apparent from the following detailed description when taken in conjunction with the accompanying drawings.

DETAILED DESCRIPTION OF THE INVENTION

Figure 1:
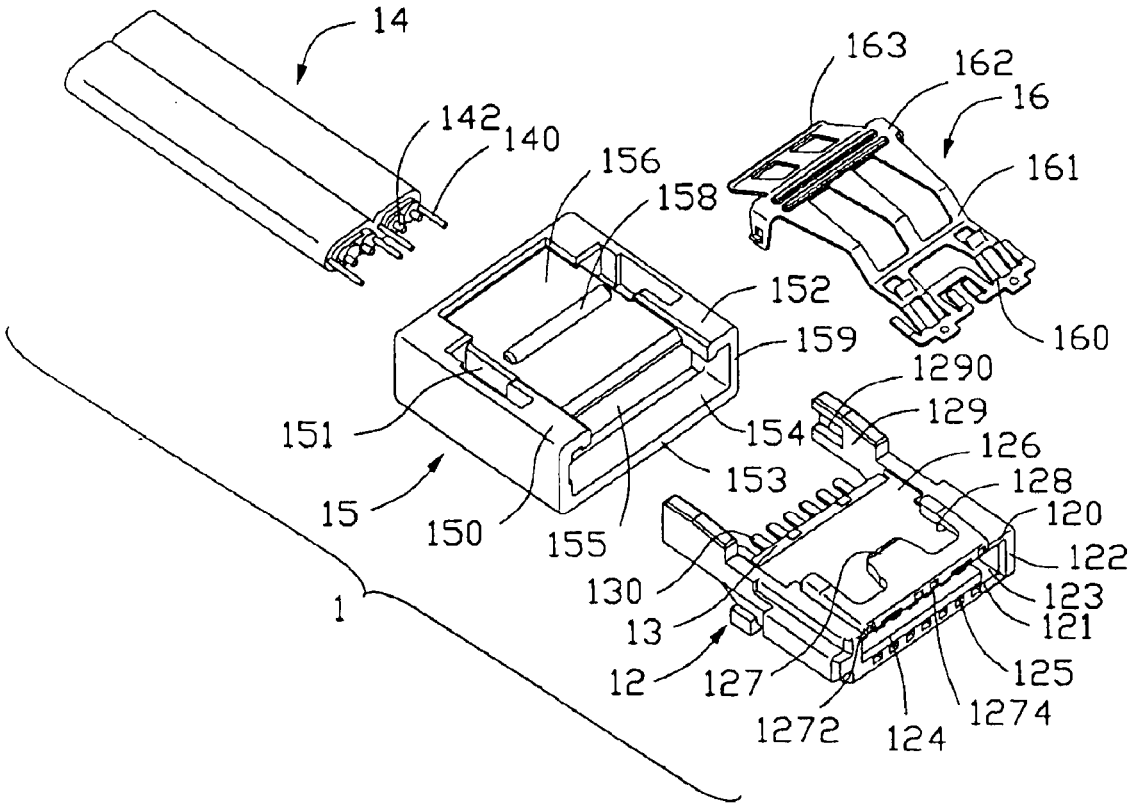
FIG. 1 is a partially exploded, perspective view of a cable end connector assembly in accordance with the present invention.
Figure 2:
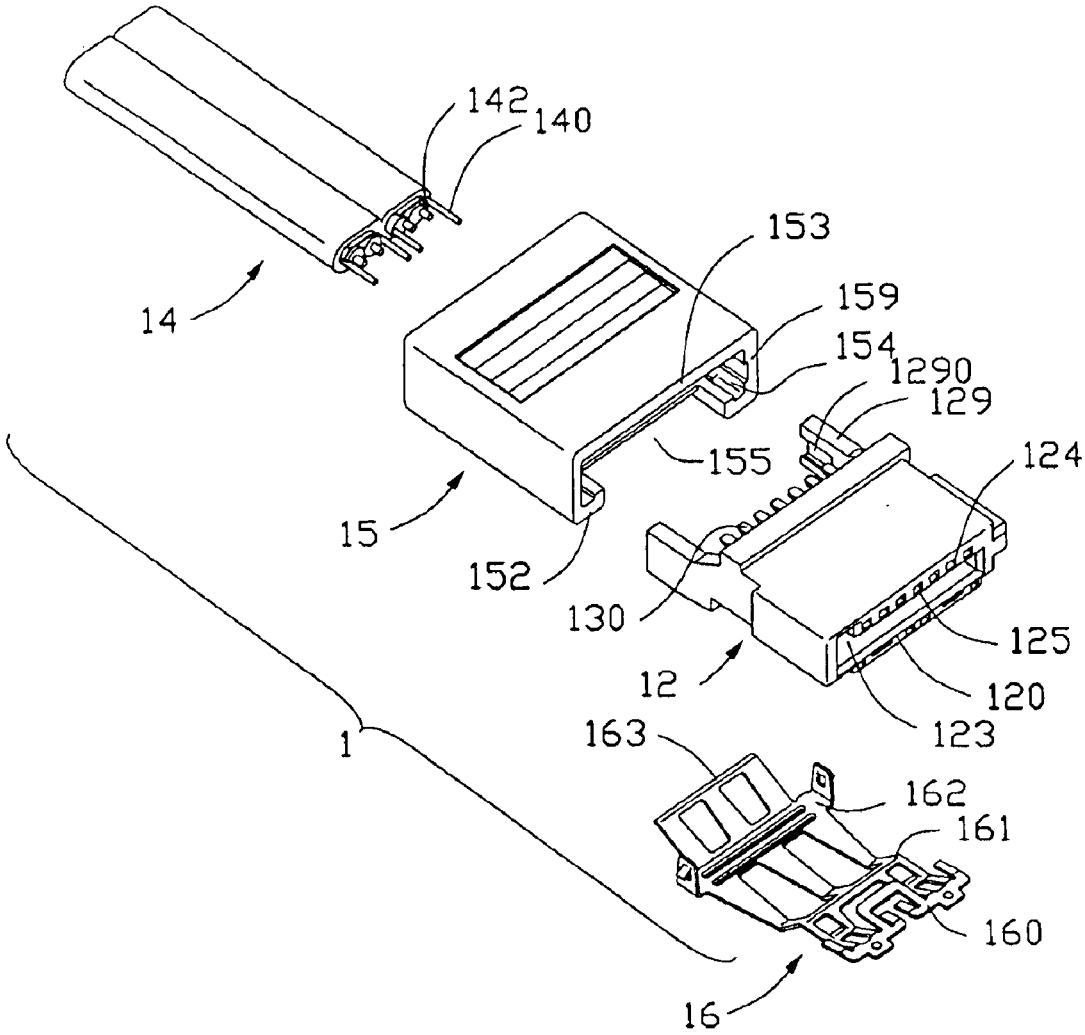
FIG. 2 is a view similar to FIG. 1, but taken from a different aspect.

Referring to FIGS. 1 and 2, a cable end connector assembly 1 in accordance with the present invention comprises an insulative housing 12, a plurality of contacts 130, a spacer 13, a cable 14, a cover 15 and a locking member 16.

Referring to FIGS. 1–2 in conjunction with FIGS. 8–11, the insulative housing 12 comprises an upper wall 120, a lower wall 121 opposite to the upper wall 120, and a pair of sidewalls 122 connecting with the upper wall 120 and the lower wall 121. An L-shaped receiving space 123 is defined between the upper and the lower walls 120, 121. A block 124 is formed on the lower wall 121 and protrudes into the receiving space 123. The block 124 defines a plurality of passageways 125 extending therethrough. The upper wall 120 defines a depression 126 on an upper surface thereof. A flat portion 127 extends rearwardly from a middle portion of a front flange of the upper wall 120 into the depression 126. A slit 1270 (FIG. 5 and FIG. 9) is formed between the flat portion 127 and a bottom surface of the depression 126. The upper wall 120 defines a pair of grooves 128 extending along opposite inner sides of the depression 126. A pair of first slots 1272 and a pair of second slots 1274 extend rearwardly from a front face of the upper wall 120 into the flat portion 127 and communicate with the slit 1270, respectively. A pair of wing portions 129 respectively extend rearwardly from the sidewalls 122. Each wing portion 129 defines a cutout 1290 in a rear portion thereof.

The contacts 130 are received in the passageways 125 of the insulative housing 12 with tail portions (not labeled) thereof extending rearwardly beyond a rear face of the insulative housing 12. The spacer 13 is mounted to a rear end of the insulative housing 12 and defines a plurality of through holes (not labeled) for allowing the tail portions of the contacts 130 extending therethrough. The spacer 13 can prevent plastic from entering into the passageways 125 of the insulative housing 12 during the molding of the cover 15. The contacts 130 and the spacer 13 can be integrally formed before mounting to the insulative housing 12, if desired.

The cable 14 has an eye-shaped cross section and comprises a pair of groups. Each group comprises a differential signal pair 142 and a pair of grounding conductors 140 arranged at opposite sides of the differential pair 142.

The cover 15 is over-molded with the insulative housing 12 and the cable 14 and comprises a rectangular body portion 150. The body portion 150 comprises an upper plate 152, a lower plate 153 opposite to the upper plate 152, and a pair of side plates 159 connecting with the upper plate 152, the lower plate 153. A receiving cavity 154 is defined between the upper and the lower plates 152, 153 for receiving a rear end of the insulative housing 12. The upper plate 152 defines a cutout 155 in a front end thereof and a pair of passages 151 in a rear end thereof communicating with the receiving cavity 154. Each passage 151 has a relatively smaller size in a front portion and a relatively bigger size in a rear portion. The upper plate 152 defines a depression 156 adjacent to a rear edge thereof and a pivot portion 158 is formed between the pair of passages 151 in a lateral direction of the cover 15.

Figure 3:
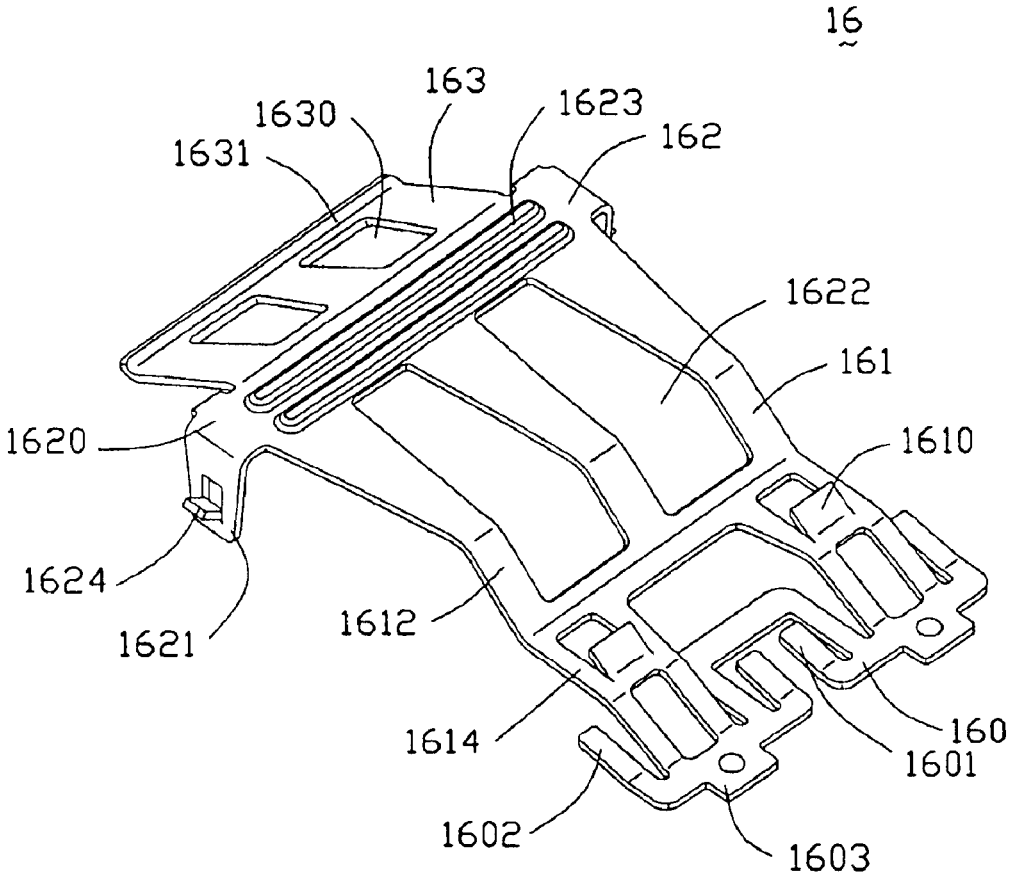
FIG. 3 is an enlarged view of a locking member of the cable end connector assembly of FIG. 1.

Particularly referring to FIG. 3, the locking member 16 is stamped and formed from a metallic plate and comprises a retaining portion 160, a locking portion 161 extending upwardly and rearwardly from the retaining portion 160, a flat pressing portion 162 extending rearwardly from the locking portion, and a supporting portion 163 extending rearwardly and downwardly from the pressing portion 162. The retaining portion 160 has a pair of bar sections 1602 extending rearwardly from opposite ends thereof, a pair of snap sections 1601 extending upwardly and rearwardly from a middle portion of a front end thereof and a pair of positioning sections 1603 extending forwardly from the front end thereof. The locking portion 161 is substantially L-shaped and comprises a first section 1614 extending rearwardly from the retaining portion 160 and a second section 1612 extending rearwardly and upwardly from the first section 1614. The first section 1614 is formed with a pair of latch sections 1610 extending upwardly and rearwardly from a front portion thereof. The pushing portion 162 comprises a body section 1620 and a pair of side beams 1621 at rear portion thereof and extending downwardly from opposite lateral ends of the body section 1620. Each side beam 1621 is stamped with a spring tab 1624 extending outwardly therefrom. The body section 1620 is formed with a plurality of ribs 1623 at the rear portion for facilitating handling. A pair of first openings 1621 is defined in a front portion of the body section 1620 of the pressing portion 162 and the second section 1614 of locking portion 161. The supporting portion 163 also defines a pair of second openings 1630 and forms a curved edge 1631 at a free end thereof. The first and the second openings 1611, 1630 are defined for perfect deformation of the locking portion 161 and the supporting portion 163.

Referring to FIGS. 4–7 in conjunction with FIGS. 1–2 and 8–11, in assembly, the signal pairs 142 and the grounding conductors 140 of the cable 14 are first soldered to the tail portions of the contacts 130, which are exposed outside the insulative housing 12. The cover 15 is over-molded with the rear end of the insulative housing 12 and the front end of the cable 14. The cutout 155 of the cover 15 communicates with the depression 126 of the insulative housing 12. The wing portions 129 are over-molded by the cover 15 and partially exposed beyond the passages 151. The wing portion 129 abuts against a front edge of the passage 151 for preventing the wing portion 129 from escaping the passage 151.

Figure 4:
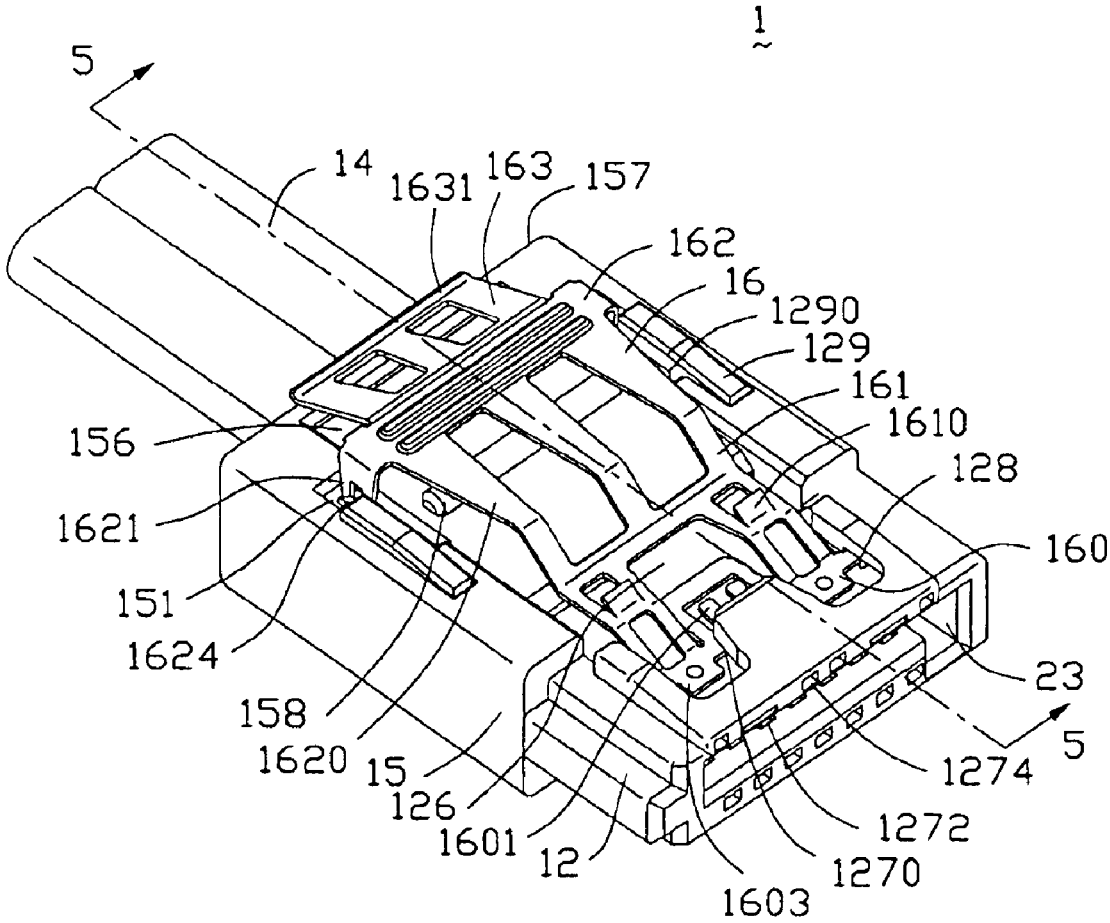
FIG. 4 is a partially assembled view of FIG. 1.
Figure 5:
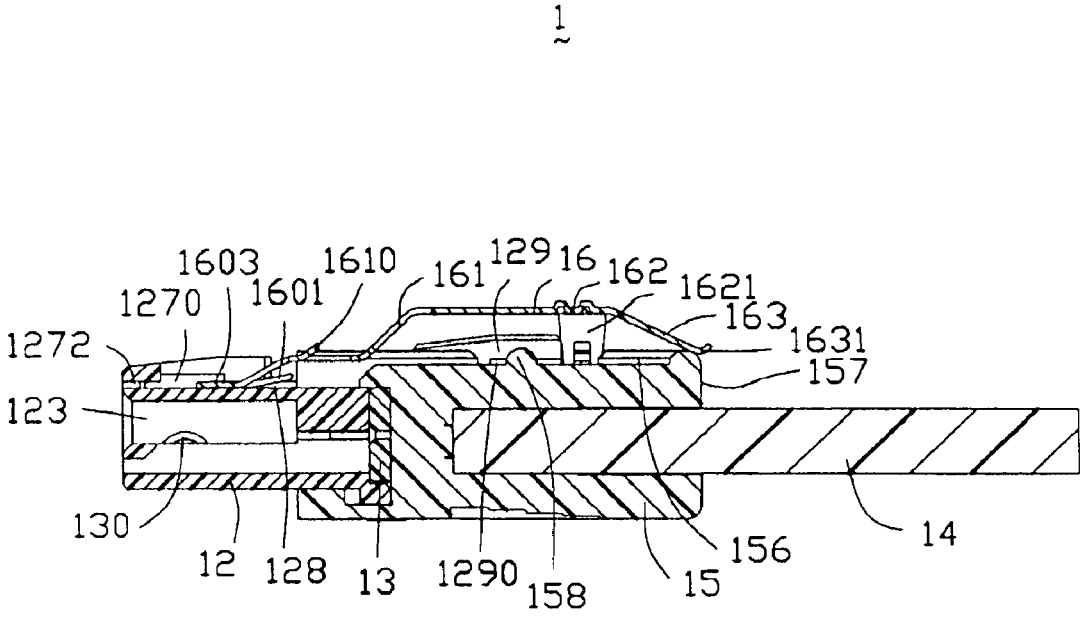
FIG. 5 is a cross-sectional view taken along line 5—5 of FIG. 4.
Figure 6:
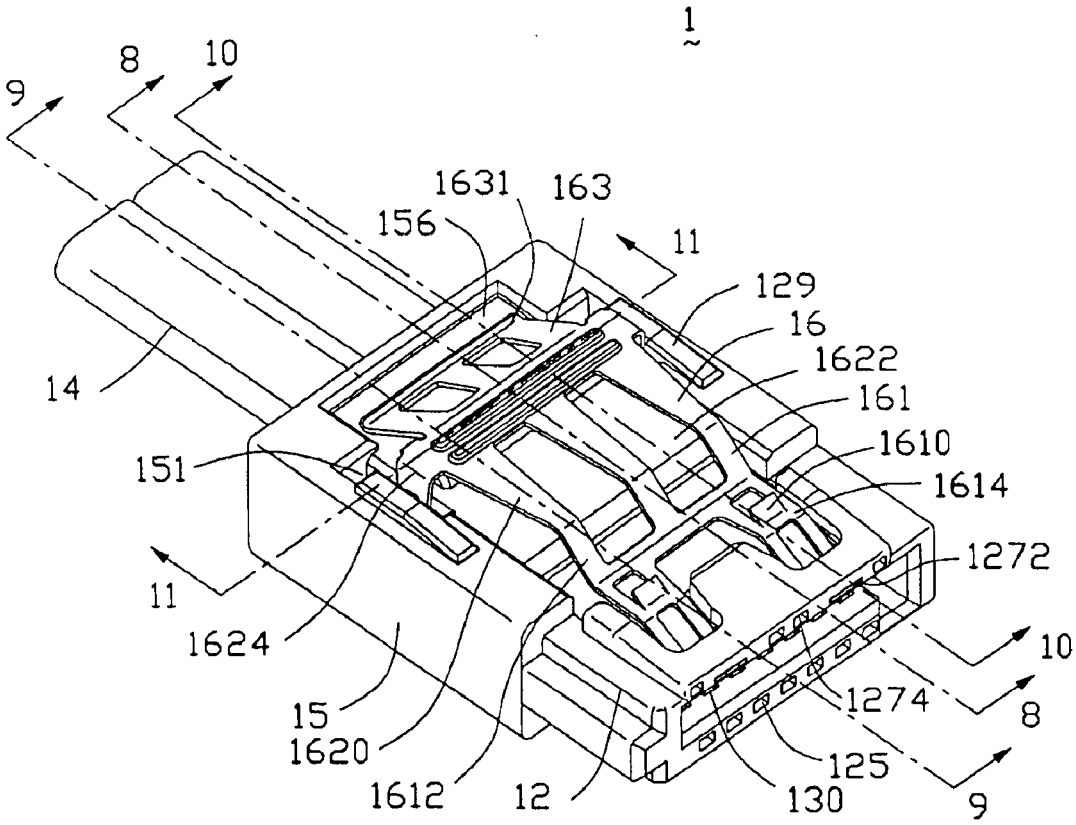
FIG. 6 is an assembled view of FIG. 1.
Figure 7:
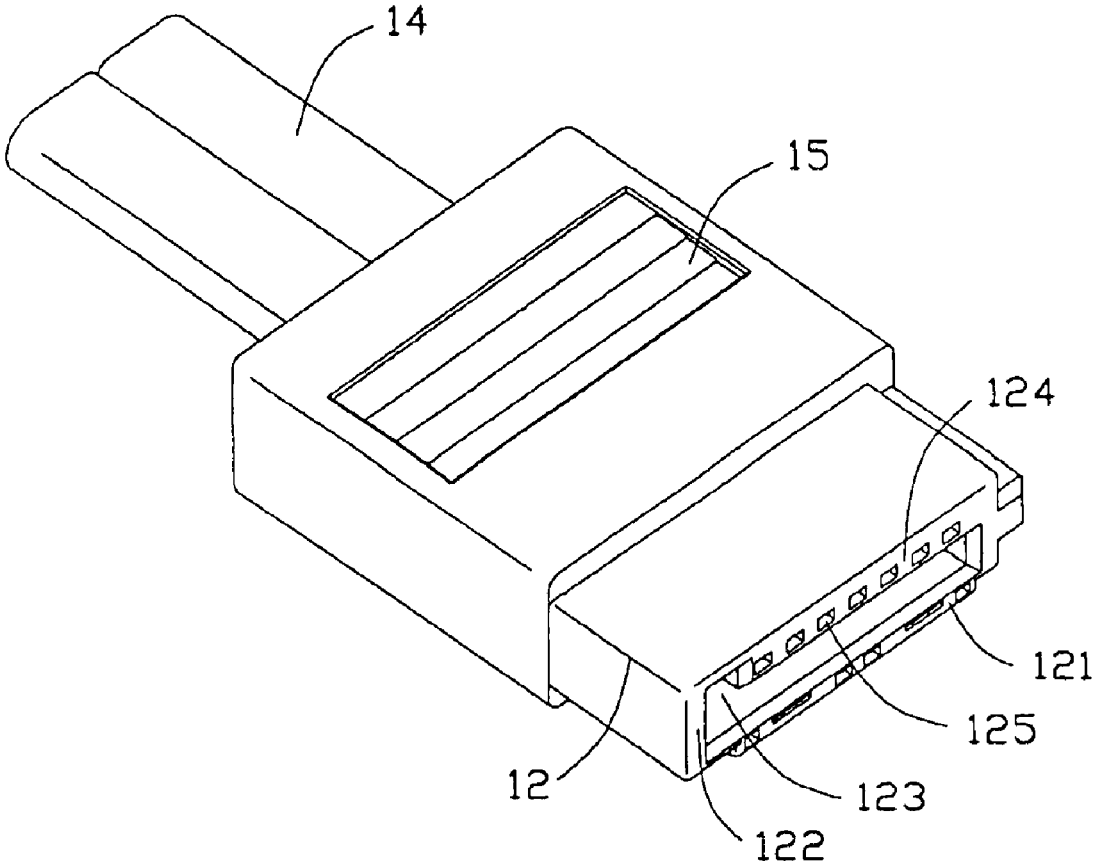
FIG. 7 is a view similar to FIG. 6, but taken from a different aspect.
Figure 8:
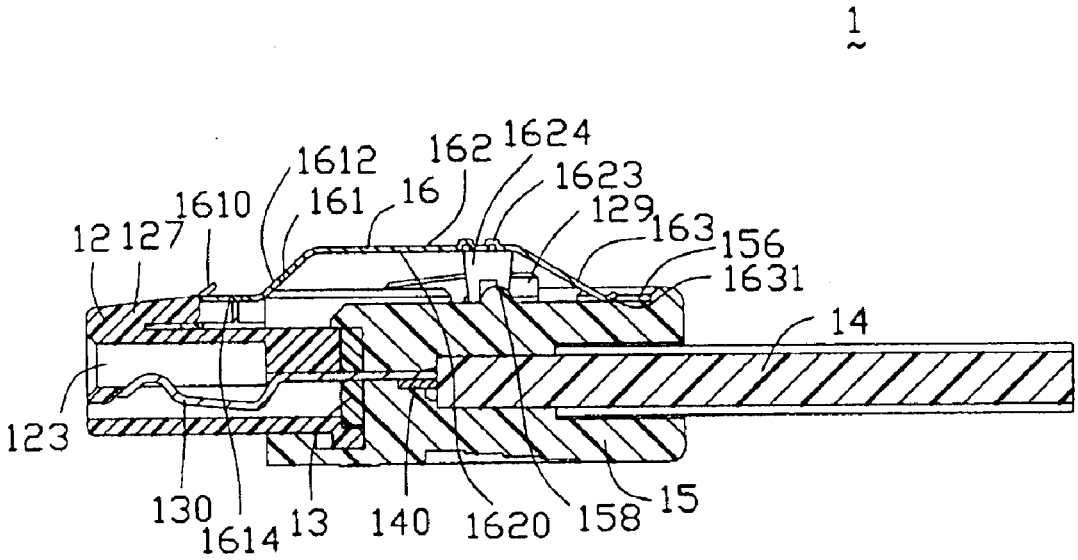
FIG. 8 is a cross-sectional view taken along line 8—8 of FIG. 6.
Figure 9:
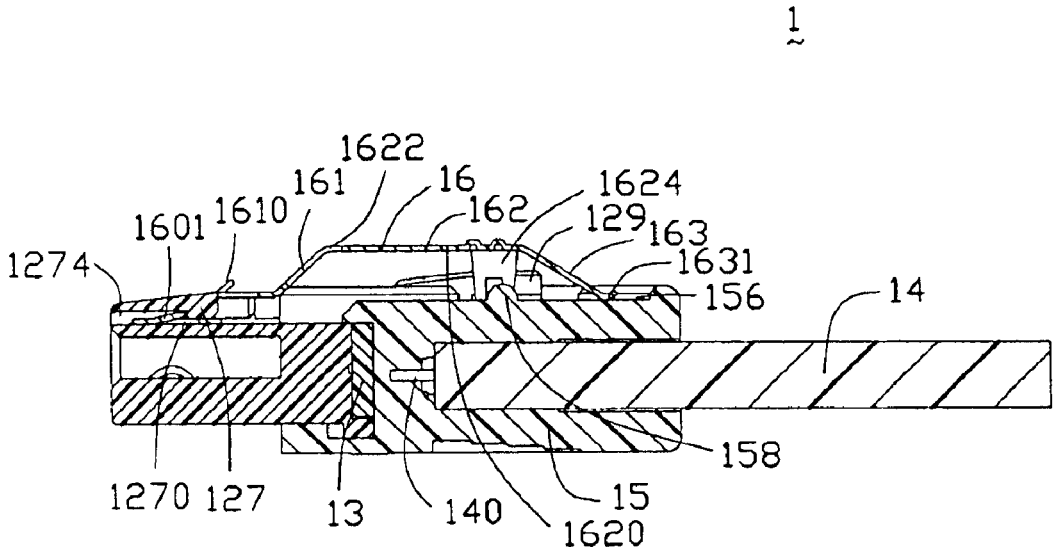
FIG. 9 is a cross-sectional view taken along line 9—9 of FIG. 6.
Figure 10:
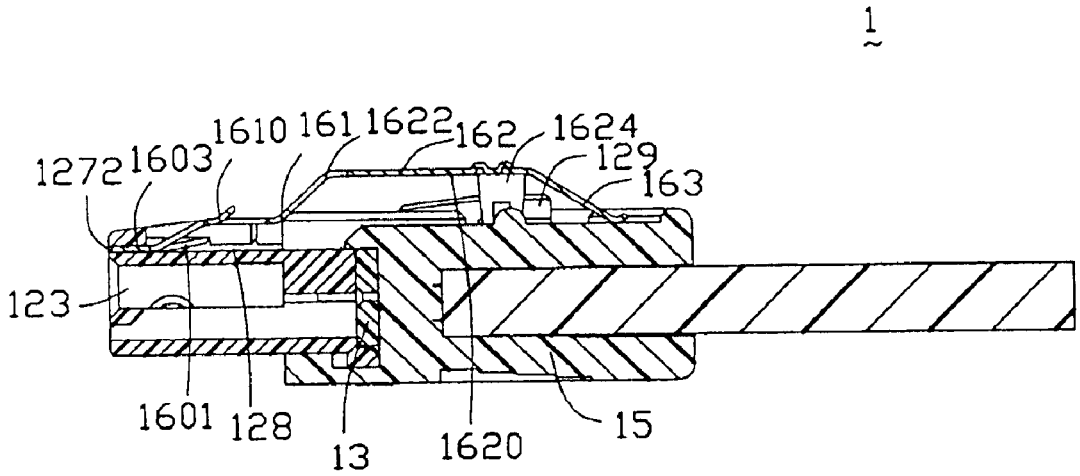
FIG. 10 is a cross-sectional view taken along line 10—10 of FIG. 6.
Figure 11:
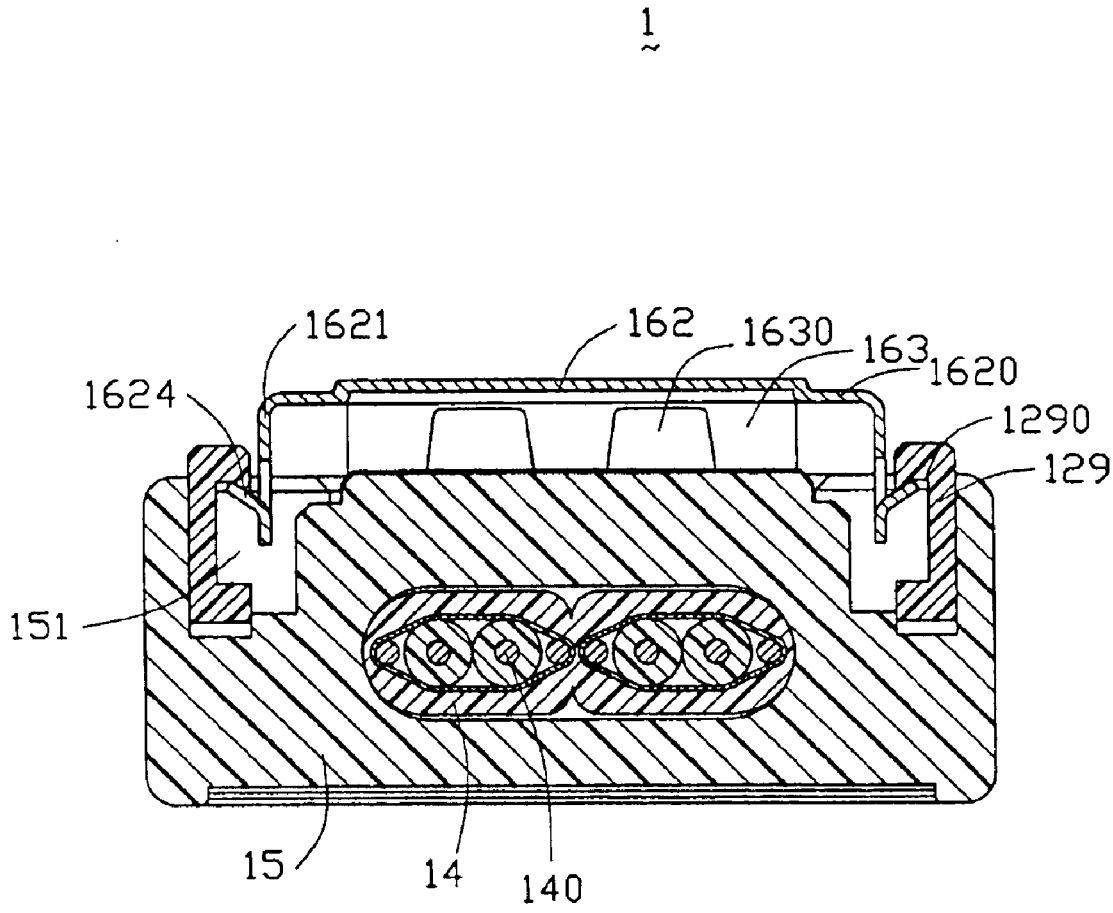
FIG. 11 is a cross-sectional view taken along 11—11 of FIG. 6.

Particularly referring to FIGS. 4 and 5, the locking member 16 is assembled to the insulative housing 12 and the cover 15. Firstly, a forward pressing force is exerted on the locking member 16. The pair of side beams 1621 of the locking member 16 are partially inserted into the rear portions of the passages 151 and pushed adjacent to wing portions 129 of the insulative housing 12, respectively. The curved edge 1631 of the supporting portion 163 is exposed beyond a rear surface 157 of the cover 15. The front end and the pair of bar sections 1602 of the retaining portion 160 are respectively pushed to be partially received in the slit 1270 and the grooves 128 of the insulative housing 12. Then, a downward and a forward pressing force are exerted on the pressing portion 162 of the locking member 16 in turn. The spring tabs 1624 of the pressing portion 162 are pressed into the cutouts 1290 of the wing portions 129 and slide along the cutouts 1290. The bar sections 1602 are received in the grooves 128 of the insulative housing 12. The middle portion of the retaining portion 160 is received in the slit 1270 with the positioning sections 1603 and the snap sections 1601 respectively locked with the first and the second slots 1272, 1274 to prevent the locking member 16 from moving rearwardly when the cable end connector assembly 1 mates with a complementary connector (not shown). The supporting portion 163 is located in the depression 156 of the cover 15 with the curved edge 1631 abuts against a bottom surface of the depression 156. The spring tabs 1624 of the pressing portion 162 elastically engage with inner surfaces of the cutouts 1290 for preventing the locking member 16 from escaping the cutouts 1290 of the housing 12. The pressing portion 162 is downwardly movable relative to the rear portion of the cover 15 to deflect the locking portion 161 toward the cover 15 and the insulative housing 12.

When the cable end connector assembly 1 is to be mated with the complementary connector, a downward pressing force is exerted on the pressing portion 162 of the locking member 16. The pressing portion 162 moves downwardly until the rear portion of the body section 1620 contacts with the pivot portion 158 of the cover 15 and the locking portion 161 creates a vertical displacement toward the housing 12. The body section 1620 then becomes curve toward the cover 15 under the pressing force with the locking portion 161 creating a further vertical displacement. Since the retaining portion 160 and the supporting portion 163 respectively engage with the cover 15 and the insulative housing 12 and thus, together form a girder. The vertical displacement of the locking portion 161, particularly the latch sections 1610, is big enough to realize the lock between the cable end connector assembly 1 and the complementary connector easily. When the cable end connector assembly 1 is to be disengaged from the complementary connector, a contrary operating procedure is applied. Because of the relatively big displacement of the latch sections 1610, the disengagement between the cable end connector assembly 1 and the complementary connector is also easy to realize.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable end connector assembly for mating with a complementary connector, comprising:

an insulative housing comprising a pair of wing portions extending along a front-to-rear direction from a rear end thereof;

a plurality of contacts received in the insulative housing;

a cable comprising a plurality of conductors electrically connecting with corresponding contacts;

a cover enclosing the rear end of the insulative housing and defining a pair of passages, said wing portions of the insulative housing respectively received in the passages; and a locking member comprising at a front end thereof a retaining portion secured with the insulative housing, a supporting portion at a rear end thereof engaged with the cover, a pressing portion close to the supporting portion and respectively engaged with the pair of wing portions of the insulative housing, and at least one latch section located on the front end thereof close to the retaining portion and adapted for locking with the complementary connector, the pressing portion being movable along a direction perpendicular to said front-to-rear direction and curve toward the cover under a pressing force wherein the pressing portion of the locking member comprises a body section and a pair of side beams extending vertically from the body section, and wherein the wing portion of the insulative housing defines a cutout to receive the side beam of the locking member and allow the side beam a restricted up and down movement.

2. The cable end connector assembly as claimed in claim 1, wherein the side beam forms a spring tab engaged in the cutout of the wing portion for preventing the pushing portion from escaping the cutout.

3. The cable end connector assembly as claimed in claim 1, wherein the cover forms a pivot portion, and wherein the body section of the pressing portion moves toward the cover until contacting the pivot portion under the pressing force.

4. The cable end connector assembly as claimed in claim 1, wherein the cover defines a depression at a rear end thereof, and wherein the supporting portion is located in the depression.

5. The cable end connector assembly as claimed in claim 4, wherein the supporting portion extends downwardly and rearwardly from the body section of the pressing portion, and wherein the supporting portion forms a curved edge at a free end thereof and pressing on a bottom surface of the depression of the cover.

6. The cable end connector assembly as claimed in claim 1, wherein the insulative housing defines a pair of grooves, and wherein the retaining portion of the locking member comprises a pair of bar sections extending from opposite ends thereof and received in the grooves.

7. The cable end connector assembly as claimed in claim 1, wherein the locking member further comprises a locking portion including a first section extending rearwardly from the retaining portion and a second section formed between the first section and the pressing portion, and wherein the at least one latch section is formed on the first section.

8. The cable end connector assembly as claimed in claim 7, wherein the second section extends upwardly and rearwardly from the first section and connects with the pressing portion.

9. The cable end connector assembly as claimed in claim 1, wherein the insulative housing defines a slit receiving a middle portion of the retaining portion of the locking member.

10. The cable end connector assembly as claimed in claim 9, wherein the insulative housing defines a first slot communicating with the slit, and wherein the locking member forms a positioning section extending forwardly from the middle portion of the retaining portion and being locked within the first slot.

11. The cable end connector assembly as claimed in claim 9, wherein the insulative housing defines a second slot communicating with the slit, and wherein the locking member comprises a snap section extending rearwardly from the middle portion of the retaining portion and being locked within the second slot.

12. The cable end connector assembly as claimed in claim 1, wherein the body section of the pressing portion is formed with a plurality of ribs.

13. The cable end connector assembly as claimed in claim 1, wherein the cover is made of insulative material and is over-molded to the rear end of the insulative housing.

14. The cable end connector assembly as claimed in claim 1, wherein the conductors of the cable comprise a pair of signal differential pair and a pair of grounding conductors arranged at opposite sides of the differential pair.

15. The cable end connector assembly as claimed in claim 1, further comprising a spacer assembled to the rear end of the insulative housing for segregating tail portions of the contacts from the insulative housing.

16. The cable end connector assembly as claimed in claim 1, wherein the insulative housing defines an L-shaped receiving space in a front end thereof and adapted for mating with the complementary connector.

17. An electrical connector assembly comprising:

an insulative housing defining at least one wing portion;

a cutout formed in the wing portion, said cutout extending along a front-to-back direction;

a plurality of contacts disposed in the housing;

a cable including a plurality of conductors electrically connected to the corresponding contacts, respectively;

a cover enclosing said housing and said cable; and a locking member attached to at least one of said cover and said housing, said locking member defining a fixed point substantially immoveable to the said one of the cover and the housing, and one locking point moveable relative to the fixed point for locking a complementary connector, and a retention tab not only moveable relative to the fixed point but also restrictively moveable in said cutout in a vertical direction perpendicular to said front-to-back direction, so that the locking member is able to be restrictively up and down moveable relative to the housing for engagement with or disengagement from the complementary connector wherein the cover defines a passage to allow the retention tab to pass and further enter the cutout during assembling.

* * * * *